United States Patent [19]

Bouvin

[11] 4,133,485

[45] Jan. 9, 1979

[54] ATOMIZER AND USES THEREOF

[75] Inventor: Jacques Bouvin, Saint Martin du Vivier, France

[73] Assignee: Esso Societe Anonyme Francaise, Paris, France

[21] Appl. No.: 714,370

[22] Filed: Aug. 16, 1976

[30] Foreign Application Priority Data

Aug. 27, 1975 [FR] France ..... 75 26350

[51] Int. Cl.[2] ..... B01F 13/04; B05B 1/34

[52] U.S. Cl. ..... 239/399; 138/42; 239/403; 239/488; 366/339

[58] Field of Search ..... 239/399, 400, 402–404, 239/463, 466, 474, 483, 487, 488; 138/42; 259/4 R, 4 A, 4 AB, 4 AC; 366/339

[56] References Cited

U.S. PATENT DOCUMENTS

| | | | |
|---|---|---|---|
| 2,284,255 | 5/1942 | Baureschmidt | 259/4 AB |
| 2,878,063 | 3/1959 | Kish et al. | 239/400 X |

FOREIGN PATENT DOCUMENTS

| | | | |
|---|---|---|---|
| 2104219 | 8/1972 | Fed. Rep. of Germany | 259/4 AB |
| 2455103 | 5/1975 | Fed. Rep. of Germany | 239/402 |
| 729226 | 5/1955 | United Kingdom | 239/399 |
| 1189484 | 4/1970 | United Kingdom | 239/399 |

*Primary Examiner*—Evon C. Blunk
*Assistant Examiner*—Andres Kashnikow
*Attorney, Agent, or Firm*—F. Donald Paris

[57] ABSTRACT

An atomizing device for mixing or atomizing fluids without moving parts and comprising, in combination, a hollow tube which has a substantially cylindrical inner wall and a core member situated within the tube in substantial coaxial relationship with and spaced from the inner wall. The surface of the core member includes at least one non-intersecting helical channel which extends substantially continuously for the length of the channel. Also, channel-forming means is provided about the core member in close proximity with the surface thereof and with the inner wall of the tube, which comprises at least one layer of at least one non-intersecting helical winding. Each winding in any single layer is in the opposite direction to each winding in the next or adjacent layer and each winding in the layer nearest the core is in the opposite direction to the helical channel formed in the core member.

6 Claims, 4 Drawing Figures

ATOMIZER AND USES THEREOF

This invention relates to an atomizer or mixer apparatus and to uses thereof. The apparatus is a stationary device for bringing two or more fluids into contact, in operations such as mixing viscous liquids; preparing dispersions or emulsions; dispersing a gas in a liquid; spraying and projecting a liquid with a gas under pressure that is used as propellent; spraying a liquid fuel into a heating apparatus; bringing two liquids into contact by counter-flow; liquid-liquid extraction; bringing a liquid and a gas into contact by counter-flow; washing or absorption of a gas by a liquid; distilling; and heat exchange.

It is known to bring into contact, or mix, two or more fluids by causing them to pass together into a chamber, a pipe or a column containing a lining, obstacles or a propeller. A large number of devices have been proposed; some are very efficient but operate with rather great loss of pressure. Among the stationary mixers that are at present known, is the type which is described in U.S. Pat. No. 3,286,992. This mixer consists of a cylindrical tube in which curved blades are inserted one after the other. Curved vanes in one direction alternate with curved vanes in the opposite direction. Each vane divides the section of the tube into two and is offset 90° in relation to the one preceding and following it. With a mixer of this type containing 6 to 12 vanes, it is possible to mix very viscous products at the cost of a moderate loss of pressure through the mixer. Emulsions may be prepared by using a mixer containing from 12 to 30 vanes. Nevertheless, the performances of geometrically similar mixers are not identical; and performance can drop off quite quickly as a function of the diameter of the apparatus.

Moreover, the manufacture of this type mixer can be rather laborious. The blades or vanes are brazed together at their points of contact. A line of 6 to 30 vanes is required, which is then inserted in a close-fitting tube. The set of vanes is obviously fragile. For most of the applications of the mixer, the lateral edges of all the vanes have to be brazed to the inner wall of the tube and this operation is rather delicate.

It is a general object of this invention to provide means for contacting two or more fluids, which means is very robust device whose manufacture is simple and easy, possessing great efficiency and at the same time a moderate loss of pressure.

In accordance with the present invention there is provided an apparatus for mixing or atomizing fluids without moving parts, characterized in that it comprises in combination, a hollow tube having a substantially cylindrical inner wall; a core member located in the tube substantially coaxially with but spaced from the inner wall, and having in its surface at least one non-intersecting helical channel extending substantially continuously around its length; and channel-forming means extending round the core member in close proximity with the surface thereof and with the said inner wall, which channel-forming means consists of at least one layer of at least one non-intersecting helical winding, each winding in any one layer being of opposite hand to each winding in the next layer, and each winding in the layer nearest the core being of opposite hand to each channel in the core member.

The invention permits the fabrication of apparatus of large diameter in which the streams of fluids can be finely divided; the passages made available to them form a three-dimensional network having a multitude of meshes. In the vertical position such an apparatus may constitute a column or tower which may advantageously be used for bringing into contact, by counter-flow a gas and a liquid, or two non-miscible liquids.

However, since fabrication of the apparatus can be very simple it lends itself readily to miniaturization. Thus, the core member is preferably substantially cylindrical. Preferably, too, the channel-forming means consists of a single layer of the helical winding. A very simple and very effective mixer or atomizer in accordance with the invention is one in which the core member is a screw-like member or a metal drill. Each layer, preferably only a single layer, is formed as a winding round the core, in opposite hand. The winding can be, for example, of a strip, a circular rod, a half-circular rod, a bar of rectangular or square section. The winding must have a certain rigidity. Instead of a single core/-winding unit within the tube, two or more can be placed lengthwise in the tube, preferably with no gap between them.

In practice it will often be sufficient merely to braze etc. the winding at each end of the core member and insert the whole as a force or friction fit into the hollow tube.

Whatever the use for which the apparatus of this invention is intended, it is more effective the larger the number of turns on the core and channel means. Nevertheless, if the turns are exaggeratedly numerous, the loss of pressure through the device is likely to be unnecessarily great. The number and pitch of the turns is therefore chosen as a function of the particular use for which the apparatus is intended. As a general rule, it is desirable for each element to have at least two full turns. In most cases, the optimum number of turns of each element is from 2 to 8.

In use of the apparatus fluids to be mixed or brought into contact are injected at one end of the tube, the spiral elements react on the flow, some by exerting thrusts which tend to make it rotate in one direction, the others by exerting thrusts that tend to make it rotate in the opposite direction. For preference the elements of the device are balanced so that the resultant of the thrusts that tend to cause the flow to rotate in one direction is equal in absolute terms to the resultant of the opposing thrusts.

Apparatus according to the invention has a number of advantages. Its manufacture from semi-finished materials of everyday type only requires a very small number of moulding and assembling operations. It operates most efficiently at the cost of a very moderate loss of pressure. It possesses the remarkable feature of providing fluids with passages whose section is substantially constant. It has no constriction that might unnecessarily offer opposition to the flow and cause obstruction.

Apparatus according to the invention can be used for mixing in line two or more liquids, in particular very viscous liquids. It can be used for dispersing in one another two non-miscible fluids, one of what may be a gas, in order to prepare emulsions or effect chemical reactions.

However, apparatus in accordance with the invention has especially beneficial application in the domain of burners with pneumatic atomizing of liquid fuels.

French Pat. No. 73-41.639 and its additions No. 74-29.594, 74-29.595 (corresponding published German Application No. 2,455,103) and 75-15.854 (corresponding published German Application No. 2,622,531) describe processes and burners in which fuel is atomised by the expansion of an auxiliary gas which expands in traversing a stationary mixer. The latter consists of a chamber of elongated shape in which are inserted fixed devices imposing on the flow of fluids multiple shearings or changes of direction, or multiple successive divisions and recombinations.

It is another object of this invention to provide a burner for, and a method of, burning a liquid fuel in a variable or modulatable manner to provide variable desired amounts of heat, and which are particularly, but not exclusively, adapted for burning domestic fuel oil in low power installations in the range of from 2 to 50 KW, and more particularly in the range 2 to 20 KW.

According to an aspect of this invention there is provided a burner of this type in which the stationary mixer is one according to the invention and whose characteristics, in particular its length and the total section of the passages available to the fluids, are calculated, so that at the desired deliveries, the energy needed for atomising the fuel is furnished by the expansion of the gas along this atomizer. The burner according to this aspect of the invention, moreover, preferably comprises a nozzle fitted to the outlet of the atomizer to give the jet of atomised fuel the desired profile, and preferably, too, pipes taking to the atomizer inlet the liquid fuel and the auxiliary gas under pressure. The nozzle has one or more orifices whose section is sufficiently large, so as only to offer negligible resistance to flow. An issuing conical spray of 20 to 25° cone angle is a convenient spray profile.

The energy liberated by the expansion of the auxiliary gas along the atomizer is used with excellent efficiency to overcome the forces of cohesion of the liquid fuel.

The energy needed can be supplied by a relatively small delivery of auxiliary gas which is brought at high pressure to the atomizer inlet. It is thus possible to calculate the characteristics of the latter, in particular its length and the total section of the passages made available to the fluids, to atomise a heavy fuel oil with only 5 to 15% of its weight of steam, provided that the latter is delivered at a pressure of 5 to 20 bars to the atomizer inlet.

Conversely, the same energy can be supplied by a relatively large delivery of auxiliary gas supplied at very moderate pressure to the inlet of the atomizer; the latter's characteristics being calculated accordingly. Thus, they may advantageously be calculated to atomize domestic fuel oil with air delivered at an effective pressure of 0.2 to 2 bars, preferably 0.3 to 1 bar only to the atomizer inlet; the delivery of air being 1.3 to 13 $Nm^3$ per Kg of fuel.

The section of the passages available to the fluids being strictly constant throughout the length of the atomizer, the risks of obstruction are practically completely avoided.

In accordance with another aspect, the invention provides a method of burning a liquid fuel at variable rates in a combustion zone to produce variable amounts of heat, which process is characterized in that it comprises passing pressurized auxiliary gas at a pressure exceeding the pressure in the combustion zone and the fuel into an upstream-end of the atomizer defined, thereby forming an emulsion of fuel dispersed in the gas, discharging the emulsion from the downstream end of the atomizer as an aerosol of fuel dispersed in auxiliary gas into a cylindrical or frusto-conical divergent combustion chamber extending downstream at least from the downstream end of the tube, the energy for dispersing the fuel in the auxiliary gas and for discharging the dispersed fuel as an aerosol into the combustion chamber and for causing any air to enter the combustion chamber being substantially wholly derived from the pressurized auxiliary gas entering the atomizer, and varying the rate of supply of fuel into the upstream end of the atomizer.

Preferably, the upstream end of the combustion chamber comprises an annular member extending radially inwardly from the wall of the combustion chamber to the outer wall of the atomizer.

The combustion chamber may have orifices therethrough for the passage of air into the volume surrounded by the combustion chamber. There may be means for progressively opening and closing said orifices for regulating the said passage of air into the interior of the combustion chamber. The combustion chamber is preferably either of cylindrical (i.e., parallel sided) shape or of a frusto-conical shape which diverges in the downstream direction.

Means are preferably provided for supplying compressed oxygen-containing gas (e.g. air), constituting at least part of the auxiliary gas, to the upstream end of the atomizer at a substantially constant rate.

A preferred, but important, feature of the invention is that substantially all of the energy for converting the fuel and auxiliary gas to an emulsion in the atomizer and to an aerosol on discharge from the downstream end of the atomizer, and for causing any secondary combustion air to mix with the aerosol or combustion products thereof in the combustion chamber, is furnished by the pressurized auxiliary gas stream.

The burner preferably has a nozzle at the downstream end of the atomizer for imparting a desired shape to the aerosol discharged into the volume surrounded by the combustion chamber.

The heat output of the burner, within at least part of the operating range of the burner, may be increased and decreased by increasing and decreasing the rate of introduction of fuel into the atomizer without substantially changing the rate of introduction of the auxiliary gas stream.

There may be means for pumping liquid fuel to the upstream end of the atomizer and for introducing the fuel substantially along the axis of the atomizer, means for regulating the rate of passage of fuel into the atomizer and means for introducing the auxiliary gas into the atomizer. The gas may be introduced at about the same region as the fuel, and may conveniently be introduced radially.

In the practice of this aspect of the present invention, the auxiliary gas used for dispersing the fuel is preferably compressed air, injected into the atomizer inlet at practically constant pressure and delivery rate. The preferred fuel is domestic fuel oil or any liquid fuel whose viscosity is for preference less than 10cSt at 20° C. We have discovered, to our surprise; that domestic fuel oil may thus be atomised very satisfactorily by means of compressed air at a pressure of 0.2 to 2 bars only at the atomizer inlet, provided that the supply rate of compressed air is sufficiently great in relation to that of the fuel oil.

The compressed air used for atomising is termed hereinafter primary air. The supply rate of domestic fuel oil may be between 0.08 and 0.8 kg per cubic meter of primary air.

The fuel oil can be atomised with largely the same quantity of air, or a quantity rather greater than the stoichiometric quantity. Thus with a supply of fuel oil equal to or rather less than 0.08 kg per normal cubic meter of primary air, combustion takes place in the combustion chamber of the burner in a total premixture flame. A perfectly blue flame is then obtained.

When the delivery of fuel and that of primary air are in a ratio exceeding 0.08/kg/Nm$^3$, there is admitted to the combustion chamber by any usual suitable means the additional requirement (termed "secondary air"), to ensure complete combustion. We have found that the motion of the jet of primary air and atomised fuel leaving the nozzle is generally sufficient to draw in the necessary amount of secondary air. It may therefore be an advantage to atomise the fuel in equipment having the shape of an ejector, in which the driving fluid is the jet of primary air and atomised fuel and in which the pumped fluid is secondary air.

In order to modulate the heating output, an advantageous method of operating the burner of the invention comprises:

a system of operation at reduced pressure in which the fuel delivery is less than or equal at 0.08 kg per normal cubic meter of primary air.

and a system of operation at higher output, possibly variable, in which the fuel delivery is between 0.08 and 0.8 kg, or for preference between 0.2 and 0.5 kg per cubic meter of air (primary air), and in which the necessary supplement of secondary air is brought to the flame, downstream of mixing device, by suitable means which for preference use the momentum available in the jet of atomised fuel and primary air leaving the nozzle.

For preference, the fuel is injected at the inlet of the atomizer by means of a calibrated orifice and the delivery of fuel is varied by altering the pressure above the orifice. The orifice can advantageously consist of the open extremity of a capillary tube having appropriate dimensions. The flow rate of a liquid into a capillary tube is proportional to the pressure drop per unit of length of the tube and is proportional to the fourth power of the diameter; the flow rate is in inverse proportion to the absolute dynamic viscosity of the liquid. A skilled technologist can calculate without difficulty the length and diameter of the tube making it possible to cover the desired range of deliveries, taking account of the viscosity of the fuel and the pressures available.

Aspects of the invention will now be illustrated with reference to the accompanying drawings in which.

Figure 1:
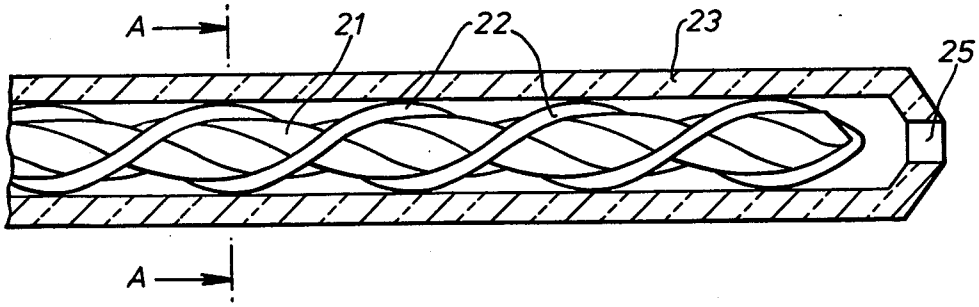
FIGS. 1 and 2 show in part longitudinal — and part cross-section, respectively, one embodiment of an atomizer according to the invention.
Figure 2:
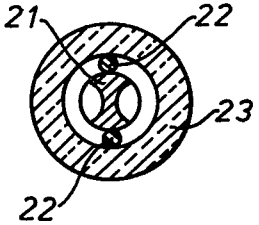

FIGS. 1 and 2 illustrate an atomizer which is especially useful in the field of domestic fuel oil burners. Core member 21 has two wide and deep twisted channels or grooves, each forming three complete turns. The shape of this element is identical with that of a metal drill. Its diameter is 4 mm and its length 80 mm. Round this element are wound two wires 22 each of whose diameters is 1 mm. The wires are wound spirally in the opposite direction to that of the turns of the core member. Each wire forms three complete turns over a length of 80 mm and is fixed to the inner element by a few spots of brazing. The assembly is inserted by friction to form a close fit in a cylindrical tube 23, whose inner diameter is 6 mm. This tube is provided at the downstream end with a nozzle 25 having a hole 3 mm in diameter.

Figure 3:
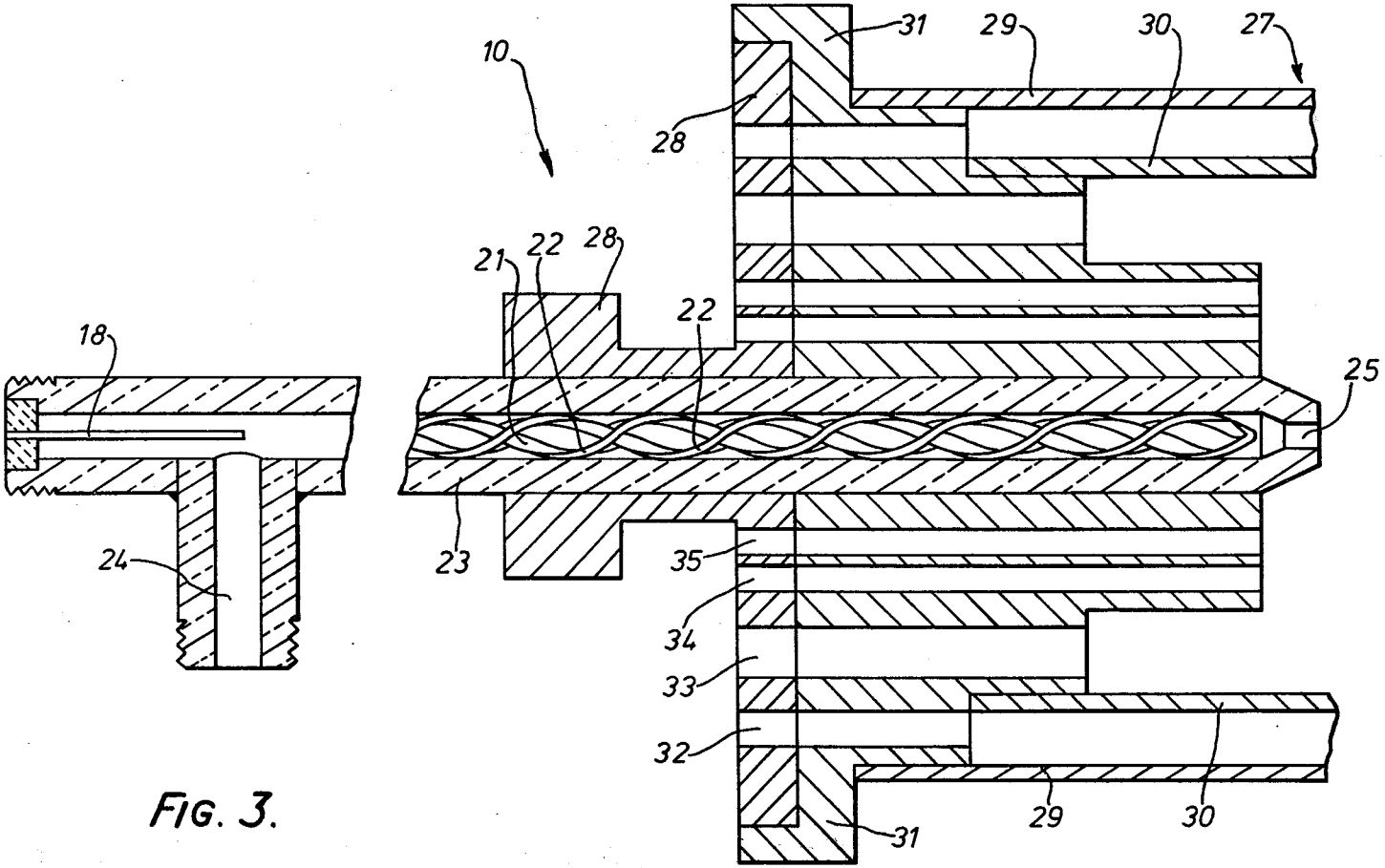
FIG. 3 is a cross-section of a burner incorporating the atomizer of FIG. 1.

With reference to cross-sectional view of FIG. 3 the burner, generally designated by numeral 10, comprises a cylindrical tube 23 having internal diameter 6 mm and having the inner core and winding 21, 22 and the nozzle 25 referred to with reference to FIGS. 1 and 2.

The nozzle 25 has a cylindrical hole with a diameter of 3 mm and is immediately downstream of the atomizer 21–23 to avoid coalescence of the dispersed fuel droplets. A cylindrical tube 29 whose length is 200 mm and diameter 56–60 mm, and a concentric cylindrical tube 30 whose length is 145 mm and diameter 44–48 mm coaxially surround the downstream end of the tube 23. These two tubes 29, 30 are attached to a rim 31 which is provided with bores forming concentric annular passages 32, 33, 34, 35 parallel to the axis of the tube 23. A rotatable crown 28 is mounted for rotation about the axis of tube 23 so as to uncover these annular passages to the extent necessary to permit entry of secondary air for combustion in accordance with the rate of supply of fuel oil. The tube 29 extends downstream of the nozzle 25 and laterally bounds the combustion volume.

Fuel oil is injectable at the inlet of the burner 10 from a capillary tube 18 whose length is 8 mm and inner diameter 0.254 mm.

Figure 4:
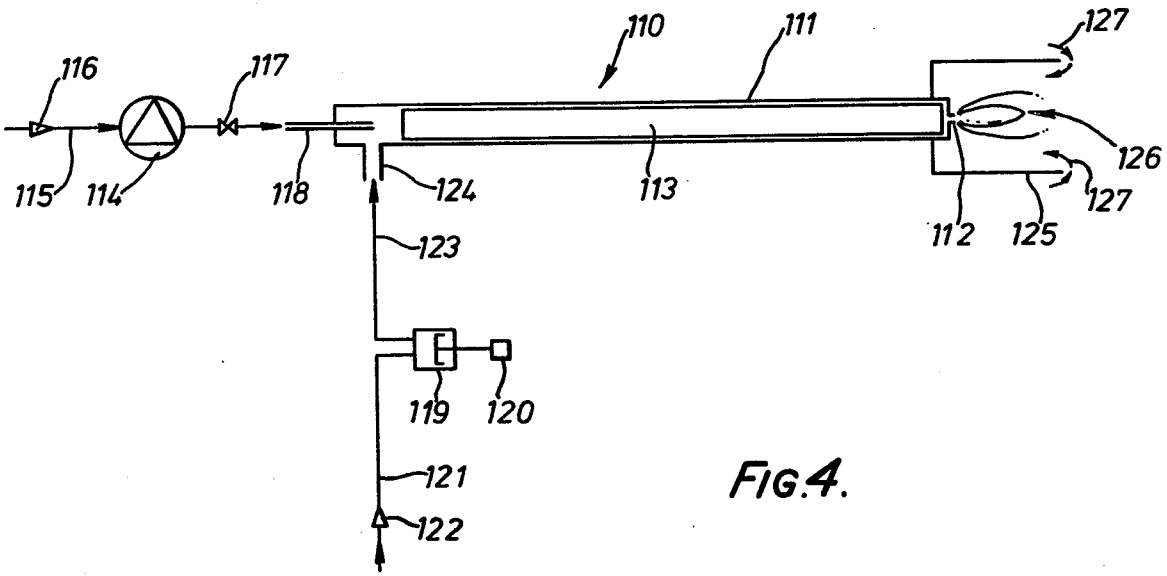
FIG. 4 is a diagram of the main parts of another burner.

Finally, with reference to FIG. 4, the burner 110 comprises a hollow tube 111, which is of substantially circular internal cross-section. At its downstream end (at the right-hand side of the diagram), it is furnished with a nozzle 112 for forming the fuel aerosol spray to a preferred shape. Within the tube 111 is an atomizer 113 which may be of any of the types according to the invention and described herein. It is preferably the type illustrated in FIGS. 1 and 2. The atomizer extends in the upstream directing away from the downstream end of the tube so as to leave as little free space as possible between the downstream end of the tube 111 and the atomizer 113 in order to avoid coalescence of fuel droplets which have been dispersed as an emulsion in an auxiliary gas by the action of atomizer 113.

A liquid fuel, such as domestic fuel oil, is induced by a pump 114 from a supply line 115 having a suitable one-way check value 116 therein and pumped at a relatively low pressure (less than 12 bars) via a flow regulating valve 117 into a capillary or like narrow tube 118 terminating within the tube 111 at or near the upstream end thereof.

An air supply pump 119 of any suitable type operated by a motor 120 (which for convenience may be an electric motor) induces air from an intake line 121 via a check valve 122, and is passed via line 123 at a suitable pressure and rate to supply all the energy necessary for the operation of the burner 110. The air pressure may be up to 1.5 bars and the air flow rate may be up to 3 Nm$^3$/h. The power of the motor 120 for such duties may be relatively small (e.g. less than 0.5 kw). Preferably, the air enters the tube 111 at about the same location as the downstream end of the tube 118 and, as shown, may enter via a radial tube 24 adjacent to the downstream end of tube 118.

The fuel and air pass towards the downstream end of the tube 111 through the atomizer 113. The expansion of the air, together with the action of the atomizer 113 in causing repeated shearing and direction changes and/or repeated division and recombination of the fuel and air streams, forms an emulsion of dispersed fuel in the air, and the emulsion is discharged from the nozzle 112 as an aerosol of fuel in air into a combustion chamber 125 of circular cross-section and which is co-axial with the axis of the tube 111. The chamber 125 is lined with suitable refractory material, and extends downstream substantially from the transverse plane of the downstream end of the tube 111. The upstream end of the chamber is closed off by an annular portion which extends radially inwardly towards the external surface of the tube 111. Although the chamber 125 is depicted as having a cylindrical lateral wall, it may alternatively be frusto-conical and divergent in the downstream direction. For most domestic applications, the internal diameter of the combusion chamber 125 may be in the range of from 30 to 100 mms (e.g., about 50 mm), and the combustion chamber may have an effective axial length of from 45 to 180 mms (e.g., c150 mms).

The aerosol of fuel dispersed in air is ignited by any suitable means to form a flame 126, and secondary air may enter the combustion chamber from the downstream end thereof, as indicated by the arrows 127. The kinetic energy of the aerosol leaving the nozzle 112, which is almost completely derived from the energy of the air entering the tube 111 via line 123, is sufficient to produce good recirculatory combustion at high intensities within the combustion chamber 125 and to induce all the necessary secondary air when the fuel input is high. The flame 126 is substantially non-luminous even at the highest heat outputs. If desired, the flame 126 may be stabilized by a suitable stabilizing body (not shown) of any known type located within the combustion chamber. Over a substantial operating range, the only regulation necessary is that of the valve 117 to control fuel input. For greater modulation or turn-down than this permits, it may be desirable to regulate the air supply in line 123 by a suitable valve (not shown) at heat outputs outside the said operating range.

EXAMPLE:— Employing the apparatus of FIG. 3 and operating as generally referred to with reference to FIG. 4. Domestic fuel oil was injected into the atomizer inlet through capillary tube 18 having a length of 8 mm and an inner diameter of 0.254 mm. It was possible to vary the delivery of fuel oil from 0.2 to 1.5 kg/h by varying its pressure from 2.4 to 11.7 bars at the inlet of the capillary. The primary air whose expansion in the atomizer ensures the atomising of the fuel oil, was supplied by the pipe 24 at practically constant pressure and delivery. At an effective pressure of 0.3 bar at the atomizer inlet, the air delivery is 2.0 $Nm^3/h$ and the combustion of the fuel oil is entirely satisfactory.

The atomizer was then replaced by one which is known per se and consists of a cylindrical tube having an inner diameter of 4 mm, in which are inserted 21 vanes curved to form spirals. Each vane divides the interior of the tube into two passages of equal section and imparts to the fluids a rotation of 180° about the axis of the tube. The length of each vane is 8 mm. Vanes curved in one direction alternate with vanes curved in the opposite direction.

In that case it was necessary to increase the pressure and delivery of the primary air to 0.6 bar and 2.2 $Nm^3/h$ respectively in order to achieve satisfactory combustion of oil over the same 0.2 or 1.5 kg/h delivery range.

I claim:

1. An apparatus for mixing or atomizing fluids without moving parts, comprising in combination: a hollow tube having a substantially cylindrical inner wall; a core member having an outer surface located in the tube substantially coaxial with but slightly spaced from the inner wall, the core member having extending inwardly from its surface at least one non-intersecting helical channel extending substantially continuously around said core member for its length; and channel-forming means secured to the core member and extending round and for the length of the core member in substantial continuous contact with said outer surface and also being in frictional contact with said inner wall such that said core member and said channel forming means are removably secured essentially only by force-fit contact with said hollow tube as an integral unit, said channel-forming means comprising one layer of at least one non-intersecting helical winding opposite to said first helical direction, the direction of each winding in said layer being opposite to the direction of each channel in said core member.

2. An apparatus as claimed in claim 1, wherein the core member is substantially cylindrical.

3. An apparatus as claimed in claim 1, wherein the number of said channels in the core member and the number of channels in the channel-forming means are each selected and constructed and arranged such that the opposite thrusts of rotation imposed by fluid which flows through said apparatus substantially balance each other.

4. An apparatus as claimed in claim 3, wherein the core member comprises two parallel helical channels and the channel-forming means comprises two parallel helical windings which are disposed in only a single layer.

5. An apparatus as claimed in claim 1, further comprising a nozzle located at the downstream end of the hollow tube constructed and arranged to operably spray the mixed or atomized fluids in a preselected spray profile for subsequent combustion.

6. A burner apparatus comprising in combination the apparatus defined in claim 5 and means located upstream of the said hollow tube for introducing at least one stream of a fluid comprising liquid fuel and at least one stream of a pressurized gas.

* * * * *